US006110020A

United States Patent [19]

Rolfi

[11] Patent Number: 6,110,020

[45] Date of Patent: Aug. 29, 2000

[54] MACHINE FOR DRYING, POLISHING AND BURNISHING CUTLERY AND METAL TABLEWARE

[75] Inventor: Emilio Rolfi, Torbole Casaglia, Italy

[73] Assignee: Hyppocampus S.r.l., Brescia, Italy

[21] Appl. No.: 09/087,756

[22] Filed: May 29, 1998

[30] Foreign Application Priority Data

May 30, 1997 [IT] Italy ..... BS97U0064

[51] Int. Cl.[7] ..... B24B 31/00

[52] U.S. Cl. ..... 451/104; 451/113; 451/327

[58] Field of Search ..... 451/326, 327, 451/113, 104

[56] References Cited

U.S. PATENT DOCUMENTS

| | | | |
|---|---|---|---|
| 1,908,104 | 5/1933 | Bell | 74/26 |
| 2,831,576 | 4/1958 | Wehner | 209/365.3 |
| 2,840,923 | 7/1958 | Behrens | 34/164 |
| 3,103,086 | 9/1963 | Balz | 451/326 |
| 3,134,207 | 5/1964 | Ferrara | 451/326 |
| 3,407,542 | 10/1968 | McKibben | 451/327 |
| 3,411,248 | 11/1968 | Dwyer et al. | 451/326 |
| 3,693,298 | 9/1972 | Ferrara . | |
| 3,862,519 | 1/1975 | Van Fossen | 451/326 |
| 3,981,693 | 9/1976 | Balz | 451/327 |
| 4,018,009 | 4/1977 | Leliaert | 451/327 |
| 4,022,012 | 5/1977 | Balz | 451/32 |
| 4,258,507 | 3/1981 | Majors et al. | 451/327 |
| 4,329,817 | 5/1982 | Balz | 451/327 |
| 4,428,161 | 1/1984 | Walther et al. | 451/327 |
| 4,693,037 | 9/1987 | McNeil . | |
| 5,036,623 | 8/1991 | Alonzo et al. | 451/113 |
| 5,117,850 | 6/1992 | Money . | |
| 5,580,300 | 12/1996 | Tsutsumi | 451/35 |
| 5,743,790 | 4/1998 | Trahan | 451/326 |
| 5,779,527 | 7/1998 | Maebashi | 451/328 |
| 5,803,800 | 9/1998 | Kobayashi et al. | 451/326 |
| 5,823,861 | 10/1998 | Kobayashi et al. | 451/326 |

*Primary Examiner*—Timothy V. Eley
*Attorney, Agent, or Firm*—McGlew and Tuttle, P.C.

[57] ABSTRACT

The invention concerns a machine for drying, polishing and burnishing cutlery, crockery and metal tableware with the help of a drying material. It includes a tank (11,21) suspended on springs (13,23) on a supporting base (12,22) and connected to a motor driven vibrator (14,24) to maintain it in continual vibration, where said tank contains the drying material and is used to receive the objects to be treated with this material. The tank make also be equipped with a chute (25) for loading the items to be treated and on one side of the tank an exit chute (26) for the treated items.

8 Claims, 2 Drawing Sheets

MACHINE FOR DRYING, POLISHING AND BURNISHING CUTLERY AND METAL TABLEWARE

FIELD OF THE INVENTION

The present invention concerns machines for drying, polishing and burnishing cutlery and metal tableware in particular.

BACKGROUND OF THE INVENTION

In restaurants, canteens, public service catering facilities and the like, plates, saucers, glasses and cutlery etc., used on the table are washed in dishwashers then dried using drying material and humidity is removed by heating.

In more sophisticated dishwashers this operation is completed by the load being passed through a tunnel where jets of very hot air dry the load through evaporation.

The metal objects, cutlery, saucers etc. are left with traces of limestone, rings and small marks, even where softened water is used and they have to be removed by manually rubbing them with alcohol or vinegar; where the metal is silver or silver plated a tarnish remover is used.

SUMMARY AND OBJECTS OF THE INVENTION

The aim of the present invention is to supply a mechanical drying system which removes every trace of limestone or mark from metal surfaces and to gradually re-polish the metal.

The hot and wet metal items are collected on exit from the dishwasher and are placed in a drier where they remain for a very short time and when taken out they are perfectly dry, without any trace of limestone or marks.

The polishing effect of the drying product maintains the shine on the metal inhibiting or delaying the visible effects of ageing.

The quality of the dried items is exactly the same from the first to the last item, and the process is completely dry and eliminates the use of labor in such a poorly qualified but certainly expensive operation.

In the case of tarnished silver, a specific product can be added to the drying material which removes all tarnish from every part of the surface.

The present invention accomplishes this aim and advantages by providing a tank containing a drying material. The wet articles are inserted into the drying material, and then the tank is vibrated to cause relative movement between the drying material and the wet articles. This relative movement causes the drying materials to absorb moisture from the wet articles and have the drying materials polish the articles.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
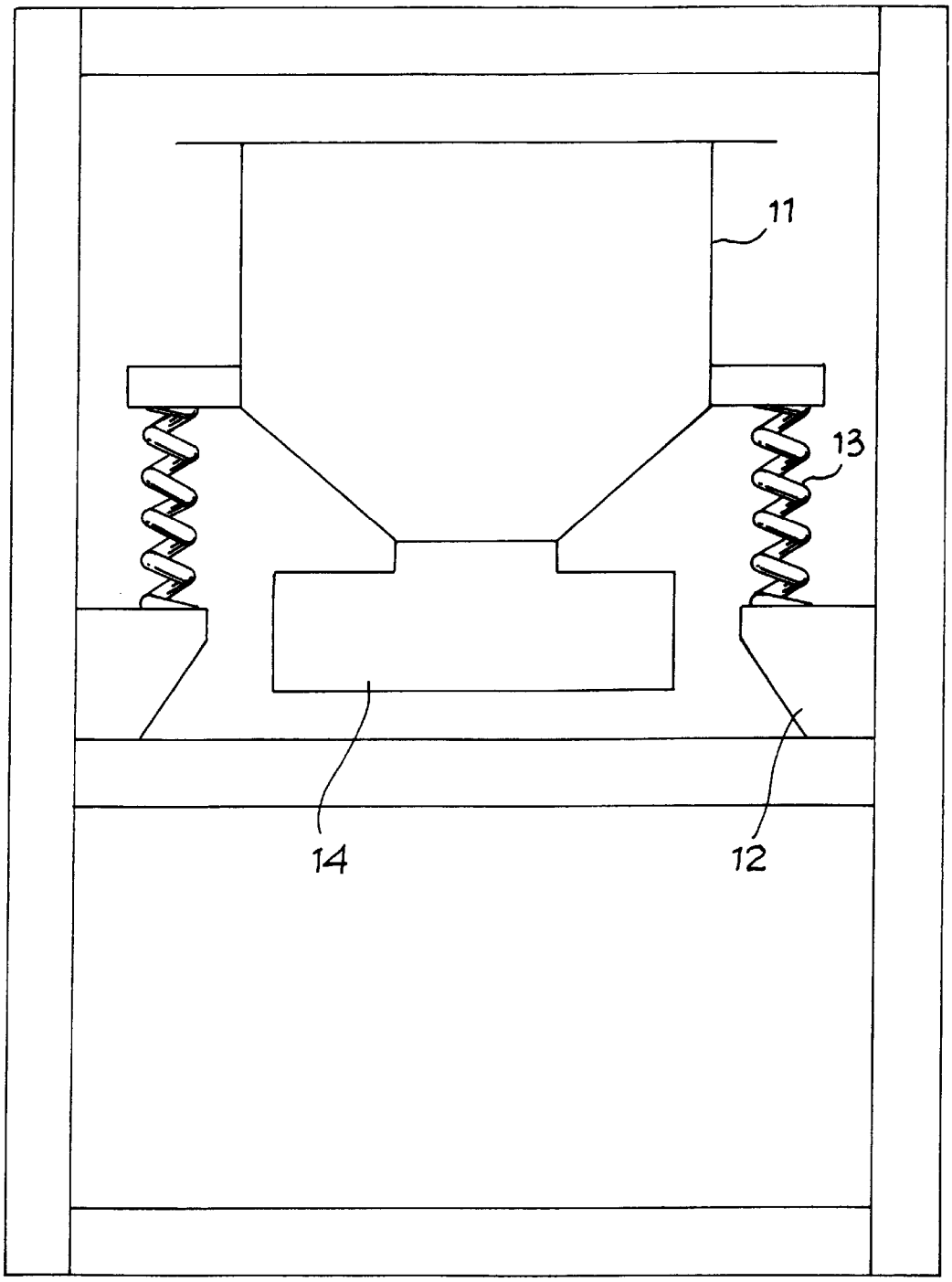
FIG. 1 is a schematic front view of a type of manual machine.

The machine shown in FIG. 1 includes a stainless steel or rubber coated tank 11 which can be any shape or size. It is suspended on a base 12 with interposition of springs 13 and connected to a motor driven vibrator 14 which keeps it vibrating.

The tank 11 contains a drying material, usually granular, such as fragments of corncobs or other products.

This machine is particularly suitable not only for drying but also for polishing cutlery, crockery and metal kitchenware. The items in question are placed in the tank containing the drying material, left there for the sufficient process time, always quite brief, in order to restore the original luster.

Figure 2:
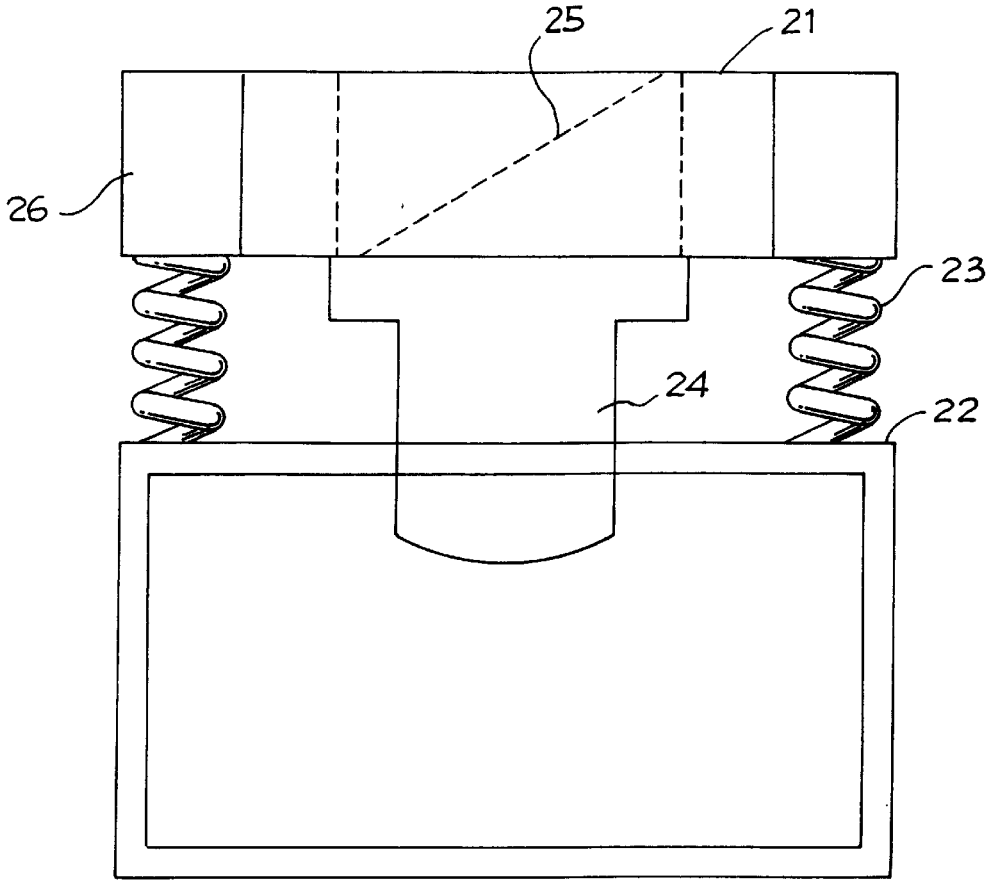
FIG. 2 is a similar schematic view of a type of automatic machine.
Figure 3:
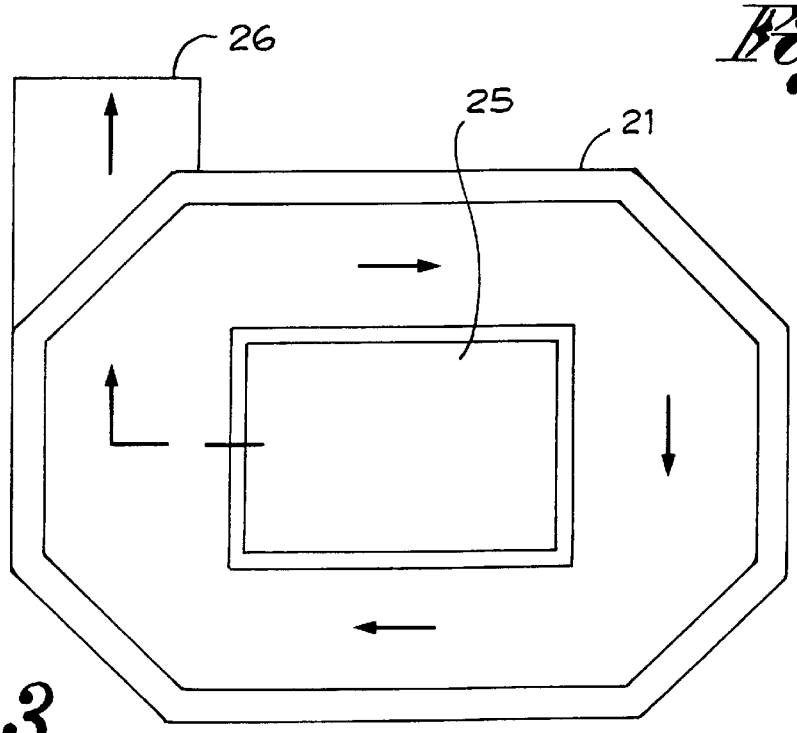
FIG. 3 is an overhead view of the machine in FIG. 2.

The machines illustrated in FIGS. 2 and 3 also have a tank 21 which is octagonal in this case but could be round or square and of any size and material.

Tank 21 is suspended on a base 22 by means of suspension springs 23 and is kept vibrating by a motor driven vibrator 24.

The tank contains drying material, and the motor driven vibrator is calibrated to vibrate both the tank and the material it contains.

This tank however differs from the fact that it has a central—see FIG. 3—entrance chute 25 for loading the objects to be polished and an exit chute 26 for the objects which have undergone treatment.

The layout is such as to keep the overall dimensions of the machine remarkably reduced. Furthermore, the vibration of the tank and drying material causes the objects loaded through the central chute 25 to automatically move forward in the drying material during the brief treatment time (45–90 sec.) so that they reach the exit chute 26 dry and polished.

While specific embodiments of the invention have been shown and described in detail to illustrate the application of the principles of the invention, it will be understood that the invention may be embodied otherwise without departing from such principles.

What is claimed is:

1. An apparatus for drying and polishing wet articles, the apparatus comprising:

a tank for receiving the wet articles, said tank including a loading chute positioned substantially in a center of said tank, said tank includes an exit chute on an outer side of said tank;

drying material arranged in said tank and receiving the wet articles;

a vibrator for vibrating said tank to cause the wet articles to move relative to said drying materials, and have said drying materials absorb moisture from the wet articles and have said drying material polish the articles, said vibrator vibrating said tank to move the wet articles from said loading chute in said center of said tank to said exit chute at said outer edge of said tank.

2. The apparatus in accordance with claim 1 wherein:

said drying materials substantially simultaneously absorb the moisture and polish the articles, said drying material is granular and includes fragments of corncobs, said drying material includes a product for removing tarnish, said drying material removes water spots and traces of limestone from the articles.

3. The apparatus in accordance with claim 1, wherein:

said drying materials substantially simultaneously absorb the moisture and has structure to polish the articles.

4. The apparatus in accordance with claim 1, wherein: said drying material is granular.

5. The apparatus in accordance with claim 1, wherein: said drying material are fragments of corncobs.

6. The apparatus in accordance with claim 1, wherein: said drying material includes a product for removing tarnish.

7. The apparatus in accordance with claim 1, wherein: said drying material has a structure to remove water spots from the articles.

8. The apparatus in accordance with claim 1, wherein: said drying material has a structure to remove traces of limestone from the articles.

* * * * *